US005718594A

United States Patent [19]

Tondreault et al.

[11] Patent Number: 5,718,594

[45] Date of Patent: Feb. 17, 1998

[54] CONNECTOR HAVING A MEMORY MODULE LOCKING APPARATUS

[75] Inventors: Robert J. Tondreault; Samuel C. Ramey, both of Louisville, Ky.

[73] Assignee: Robinson Nugent, Inc., New Albany, Ind.

[21] Appl. No.: 493,353

[22] Filed: Jun. 21, 1995

[51] Int. Cl.[6] ..... H01R 13/62

[52] U.S. Cl. ..... 439/326; 439/352

[58] Field of Search ..... 439/326, 328, 439/352, 327, 153, 157, 160

[56] References Cited

U.S. PATENT DOCUMENTS

| | | | |
|---|---|---|---|
| 4,898,540 | 2/1990 | Saito | 439/153 |
| 4,986,765 | 1/1991 | Korsunsky et al. | 439/326 |
| 4,995,825 | 2/1991 | Korsunsky et al. | 439/326 |
| 5,013,257 | 5/1991 | Korsunsky et al. | 439/326 |
| 5,013,264 | 5/1991 | Tondreault | 439/636 |
| 5,112,242 | 5/1992 | Choy et al. | 439/328 |
| 5,147,211 | 9/1992 | Tondreault et al. | 439/160 |
| 5,161,994 | 11/1992 | Sato et al. | 439/326 |
| 5,191,514 | 3/1993 | Kabat et al. | 439/328 |
| 5,209,675 | 5/1993 | Korsunsky | 439/326 |
| 5,234,354 | 8/1993 | Smart | 439/326 |
| 5,242,312 | 9/1993 | Tondreault | 439/328 |
| 5,302,133 | 4/1994 | Tondreault | 439/157 |
| 5,364,282 | 11/1994 | Tondreault | 439/157 |
| 5,366,390 | 11/1994 | Kinross et al. | 439/636 |
| 5,383,792 | 1/1995 | Korsunsky et al. | 439/326 |
| 5,389,000 | 2/1995 | DiViesti et al. | 439/160 |
| 5,417,580 | 5/1995 | Tsai | 439/328 |
| 5,429,523 | 7/1995 | Tondreault | 439/157 |
| 5,443,394 | 8/1995 | Billman et al. | 439/328 |
| 5,484,302 | 1/1996 | Yamada et al. | 439/328 |
| 5,514,002 | 5/1996 | Cheng et al. | 439/326 |

*Primary Examiner*—Hien Vu
*Assistant Examiner*—Brian J. Biggi
*Attorney, Agent, or Firm*—Barnes & Thornburg

[57] ABSTRACT

A connector apparatus is provided for electrically coupling a module having an end edge including a plurality of conductive pads to a plurality of conductive traces on a printed circuit board. The apparatus includes an insulative housing formed to include an elongated slot for receiving the end edge of the module, a plurality of contacts located in the slot for engaging the conductive pads on the module, and a side arm having an integrally formed split peg for engaging the module to secure the module to the housing. The apparatus also includes a separate clip coupled to the side arm of the housing. The clip includes an actuator section located adjacent the split peg. The actuator section is configured to engage the split peg and to release the split peg from the module to permit removal of the module from the housing.

26 Claims, 5 Drawing Sheets

CONNECTOR HAVING A MEMORY MODULE LOCKING APPARATUS

BACKGROUND AND SUMMARY OF THE INVENTION

The present invention relates to an electrical connector for electrically interconnecting a memory module to a printed circuit board. More particularly, the present invention relates to an electrical connector having an improved memory module locking apparatus for holding the memory module in place on the connector.

The electrical connector of the present invention is configured to receive small outline Dual In-Line Memory Modules (DIMMS). These memory modules are specifically described in the JEDEC Standard MO-160. The connector of the present invention and the memory modules are particularly useful in applications requiring low profile components, such as in notebook and laptop computers. The small outline connectors allow users to expand memory by adding and/or replacing memory modules with relative ease. It is understood that the present invention may be for securing any type of memory module or daughtercard to an electrical connector.

The basic configuration of the housing body of electrical connectors for receiving memory modules is also set by limitations of the JEDEC Standard and the industry requirement for second sources. However, various methods have been developed to lock the memory modules in place, hold the memory modules down, and eject the memory modules. The memory modules are typically inserted into the connector housing at an angle and then rotated until they lock into place. One known method of locking memory is the use of separate latches coupled to the connector. The memory modules are locked into place using latches which engage side edges of the printed circuit board of the module. The modules are ejected by unlocking the latches to allow the printed circuit board of the module to pop up due to the torque supplied to the module by a plurality of contacts located in the connector body.

These known latches which engage the memory module are made from metal or plastic. Typically, these known separate latches must be released by pulling the latches outwardly away from the sides of the connector body and the seated module. This outwardly directed actuation of latches can be difficult since the latches are very small and since the area in which to actuate the latches is limited.

The module locking apparatus of the present invention illustratively includes a pair of plastic split pegs molded integrally with the electrical connector housing to secure the module to the connector housing. The split pegs are each configured with ramp portions which engage the memory module during installation so that the split pegs move together and permit the memory module to be inserted into the connector. The split pegs then spring outwardly and engage opposite sides of the memory module adjacent a side notch formed in the memory module to retain the memory module within the connector. The split pegs are manually actuated by metal or plastic clips to disengage the split pegs from the memory module. The metal clips of the present invention are squeezed inwardly toward the connector body and module to release the module. By providing clips which can be squeezed in an inward direction, the locking apparatus of the present invention provides a more natural movement than pulling conventional latches outwardly away from the connector body. The unlocking motion is easier to perform with one hand by pinching the clips with an operator's thumb and finger to release the split pegs from the module. This facilitates unlocking the module from the connector in a limited amount of space.

According to one aspect of the present invention, a connector apparatus is provided for electrically coupling a module having an end edge including a plurality of conductive pads to a plurality of conductive traces on a printed circuit board. The apparatus includes an insulative housing formed to include an elongated slot for receiving the end edge of the module, a plurality of contacts located in the slot for engaging the conductive pads on the module, and a side arm having an integrally formed split peg for engaging the module to secure the module to the housing. The apparatus also includes a clip coupled to the side arm of the housing. The clip includes an actuator section located adjacent the split peg. The actuator section is configured to engage the split peg and to release the split peg from the module to permit removal of the module from the housing.

In the illustrated embodiment, the split peg includes at least one cantilevered locking member configured to engage the module to secure the module to the housing. The locking member includes a locking head having a ramp surface configured to engage the module to move the locking member relative to the housing during installation of the module. The locking head includes a bottom surface configured to engage the module to secure the module to the housing. The actuator section of the clip is configured to move the locking member in a direction generally parallel to the side arm of the housing to disengage locking member from the module.

Also in the illustrated embodiment, the module includes a side edge formed to include a side notch, and the split peg includes first and second spaced apart cantilevered locking members for engaging the module adjacent the side notch to secure the module to the housing. The clip includes a generally U-shaped actuator section having first and second arms for engaging and moving the first and second locking members to disengage the first and second locking members from the module. The first and second locking members each include a ramp portion for engaging the first and second arms of the actuator section of the clip, respectively, to move the first and second locking members relative to the module.

Illustratively, the clip is formed from a stamped sheet metal material. The clip may also be formed from plastic or other type material. The clip includes a retention section configured to engage the side arm of the housing to secure the clip to the housing.

According to another aspect of the invention, a connector apparatus is provided for electrically coupling a module having an end edge including a plurality of conductive pads to a plurality of conductive traces on a printed circuit board. The apparatus includes an insulative housing formed to include an elongated slot for receiving the end edge of the module, and first and second arms extending away from opposite ends of the slot. The apparatus also includes first and second locking members coupled to the first and second side arms, respectively, for engaging opposite side edges of the module to secure the module to the electrical connector. The apparatus further includes first and second actuators coupled to the first and second side arms, respectively, adjacent the first and second locking members. The first and second actuators are configured to move the locking members and release the module from the housing when opposite, inward forces directed toward the module are applied to the first and second actuators.

In the illustrated embodiment, the first and second locking members each include a pair of cantilevered beams for engaging the module to secure the module to the housing. The first and second actuators each include a pair of arms configured to engage the pair of cantilevered beams to disengage the cantilevered beams from the module. The cantilevered beams each include an unlocking ramp portion for engaging the first and second arms of the actuators to move the cantilevered beams relative to the module.

According to yet another aspect of the present invention, a connector apparatus is provided for electrically coupling a module having an end edge including a plurality of conductive pads to a plurality of conductive traces on a printed circuit board. The apparatus includes an insulative housing formed to include an elongated slot for receiving the end edge of the module, a plurality of contacts located in the slot for engaging the conductive pads on the module, and first and second side arms. Each of the first and second side arms have an integrally formed split peg for engaging first and second opposite side edges of the module to secure the module to the housing. The apparatus also includes first and second clips coupled to the first and second arms of the housing, respectively. The first and second clips each include an actuator section located adjacent the first and second split pegs, respectively. The actuator sections are configured to engage and move the first and second split pegs to release the split pegs from the first and second side edges of the module to permit removal of the module from the connector housing.

In the illustrated embodiment, the first and second split pegs each include first and second spaced apart cantilevered locking members for engaging the module to secure the module to the housing. The first and second locking members each include a locking head having a ramp surface configured to engage the module to move the locking member relative to the housing during installation of the module. The locking heads each include a bottom surface configured to engage the module to secure the module to the housing. The first and second clips include a generally U-shaped actuator section having first and second arms for engaging the first and second locking members to release the module from the housing. The locking members include first and second unlocking ramp portions for engaging the first and second arms of the actuator section, respectively, to move and release the locking members from the module.

Additional objects, features, and advantages of the invention will become apparent to those skilled in the art upon consideration of the following detailed description of the preferred embodiment exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
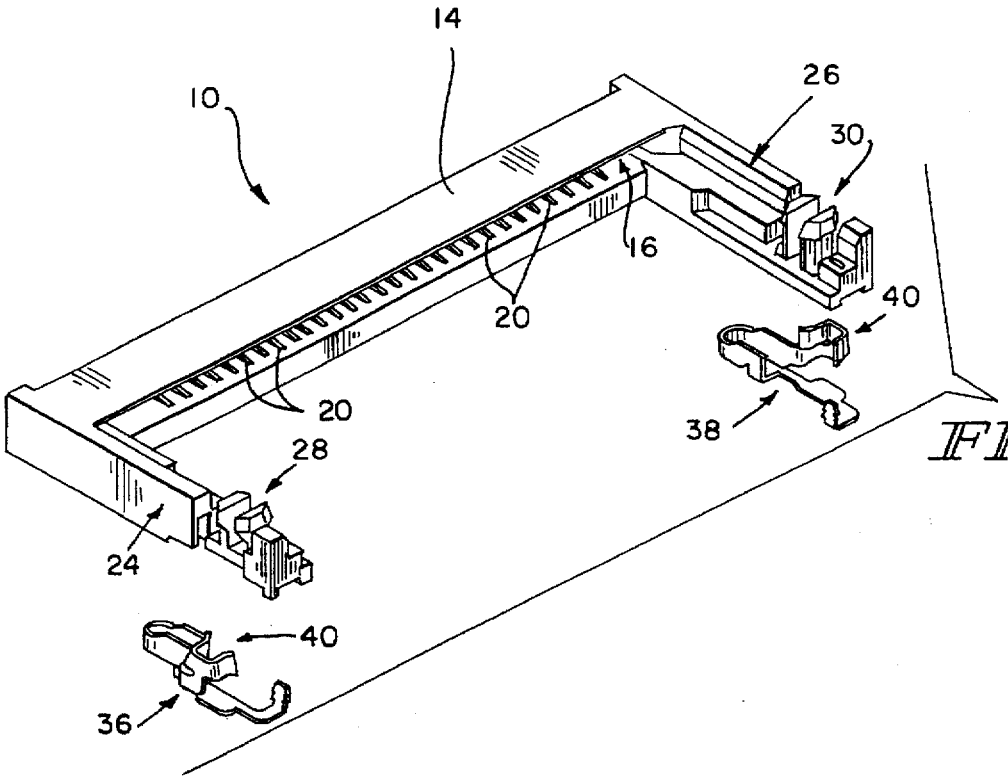
FIG. 1 is a perspective view of a first embodiment of the electrical connector of the present invention including a memory module locking apparatus.
Figure 2:
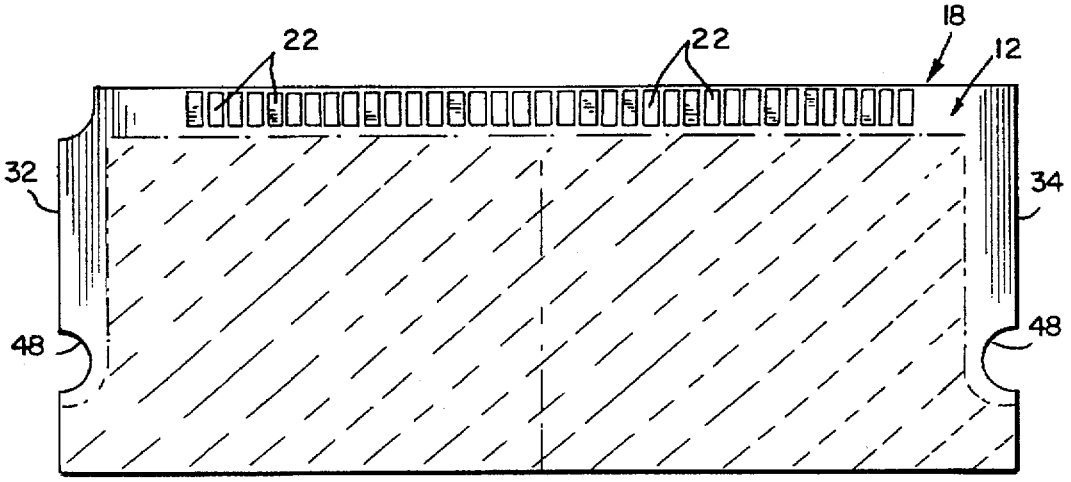
FIG. 2 is a side elevational view of a memory module card configured to be inserted into the electrical connector of FIG. 1.

Referring now to the drawings, FIG. 1 illustrates a first embodiment of an electrical connector 10 for coupling a memory module 12 illustrated in FIG. 2 to a printed circuit board. The connector 10 includes an insulative plastic housing 14 having an elongated slot 16 for receiving an end edge 18 of memory module 12 therein. Connector 10 includes a plurality of contacts 20 configured to engage conductive pads 22 formed on both sides of memory module 12 adjacent end edge 18 to couple the memory module 12 to the printed circuit board electrically. Although a memory module is disclosed, it is understood that the locking apparatus of the present invention may be used with any type module, daughtercard, or printed circuit board.

The connector 10 includes first and second side arms 24 and 26, respectively. Both the first and second side arms 24 and 26 are formed to include an insulative plastic split peg 28 and 30 formed integrally with side arms 24 and 26, respectively. Split peg 28 and split peg 30 are configured to engage opposite side edges 32 and 34, respectively, of memory module 12 to hold memory module 12 in a locked position in connector 10. A pair of metal clips 36 and 38 are configured to be coupled to side arms 24 and 26 of connector housing 14 adjacent split pegs 28 and 30. Clips 36 and 38 are each formed to include a U-shaped actuator section 40 positioned adjacent split pegs 28 and 30. Actuator sections 40 are used to actuate split pegs 28 and 30 to permit removal of memory module 12 from connector 10.

Split peg 28 is a mirror image of split peg 30. Metal clip 36 is a mirror image of metal clip 38. Therefore, only the structural features of split peg 28 and metal clip 36 will be described in detail in this application.

Figure 3:
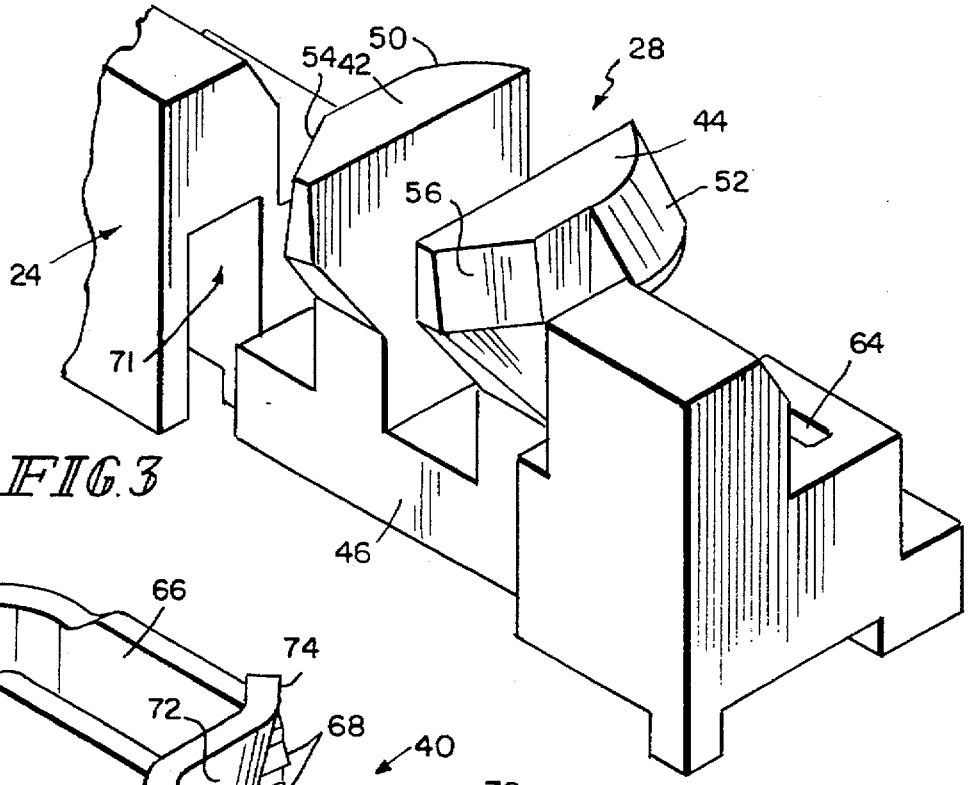
FIG. 3 is a perspective view illustrating a split peg formed on a first side arm of the connector housing for securing the memory module to the connector body.

FIG. 3 is an enlarged view of a portion of side arm 24 illustrating details of split peg 28. Split peg 28 includes first and second cantilevered locking members 42 and 44 extending upwardly from base 46. Locking member 42 of split peg 28 includes a ramp shaped locking head 50 best illustrated in FIGS. 6 and 8. Locking member 44 includes a ramp shaped locking head 52. Locking members 42 and 44 are spaced apart a predetermined distance to overlap portions of the memory module adjacent a side notch 48 as discussed in detail below. Therefore, heads 50 and 52 are configured to overlap portions of side edge 32 of memory module 12 to lock memory module 12 in place on connector 10. Locking members 42 and 44 are formed to include unlocking ramp surfaces 54 and 56. Ramp surfaces 54 and 56 of locking members 42 and 44, respectively, are configured to be engaged by the U-shaped actuator section 40 of metal clip 36 to force the locking members 42 and 44 toward each other and unlock the memory module 12 from connector 10.

Figure 4:
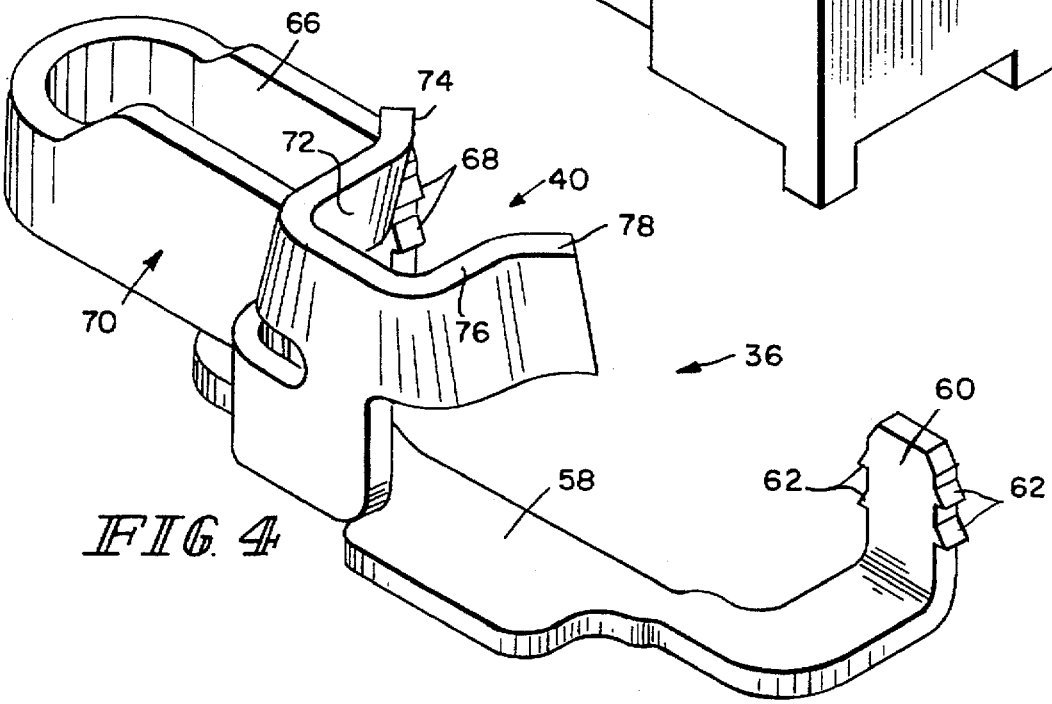
FIG. 4 is an enlarged perspective view of a metal clip configured to be installed adjacent the split peg to actuate the split peg and permit removal of the memory module.

Details of metal clip 36 are illustrated in FIG. 4. Metal clip 36 is formed from a stamped piece of flat sheet metal. Clip 36 includes a base 58 having an upwardly extending anchoring portion 60 at a first end. Anchoring portion 60 includes barbs 62 for engaging the insulative housing 14 of connector 10 to secure metal clip 36 to connector 10. Anchoring portion 60 is configured to be inserted into an aperture 64 upwardly from a bottom surface of side arm 24. Clip 36 includes a second anchoring section 66 having barbs 68 for engaging a portion of side arm 24 on an opposite side of split peg 28. Metal clip 36 includes a spring beam section 70 configured to support actuator section 40 in a generally cantilevered manner. Spring beam 70 is free to move relative to the side arm 24 inside opening 71 formed in the side arm 24. U-shaped actuator section 40 includes a first arm 72 having a lead-in ramp section 74 for engaging ramp section 54 of locking member 42. Actuator section 40 also includes a second arm 76 having a lead-in ramp section 78 for engaging ramp section 56 of second locking member 44 of split peg 28.

Figure 7:
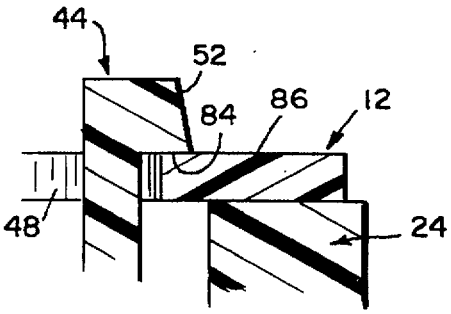
FIG. 7 is a sectional view taken along lines 7—7 of FIG. 6 illustrating engagement of a bottom surface of one locking member of the split peg with the memory module.
Figure 5:
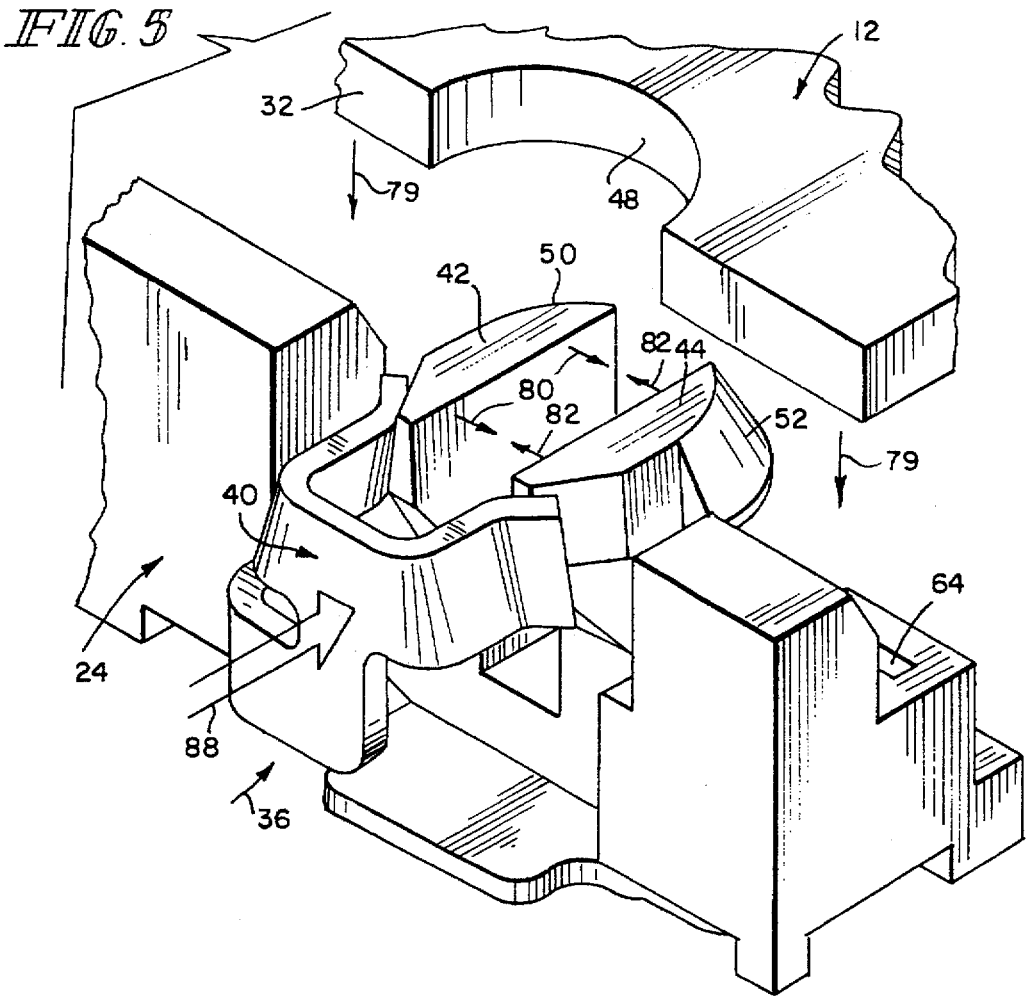
FIG. 5 is a perspective view illustrating the metal clip installed into the side arm of the connector and illustrating a side notch formed in the memory module.
Figure 6:
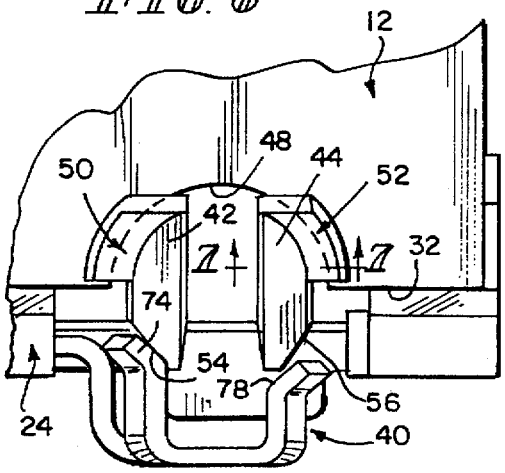
FIG. 6 is a top plan view illustrating the memory module installed in the electrical connector with the split peg in its outwardly expanded position so that first and second locking members of the split peg overlap portions of the memory module adjacent the side notch to lock the memory module in place on the connector.
Figure 10:
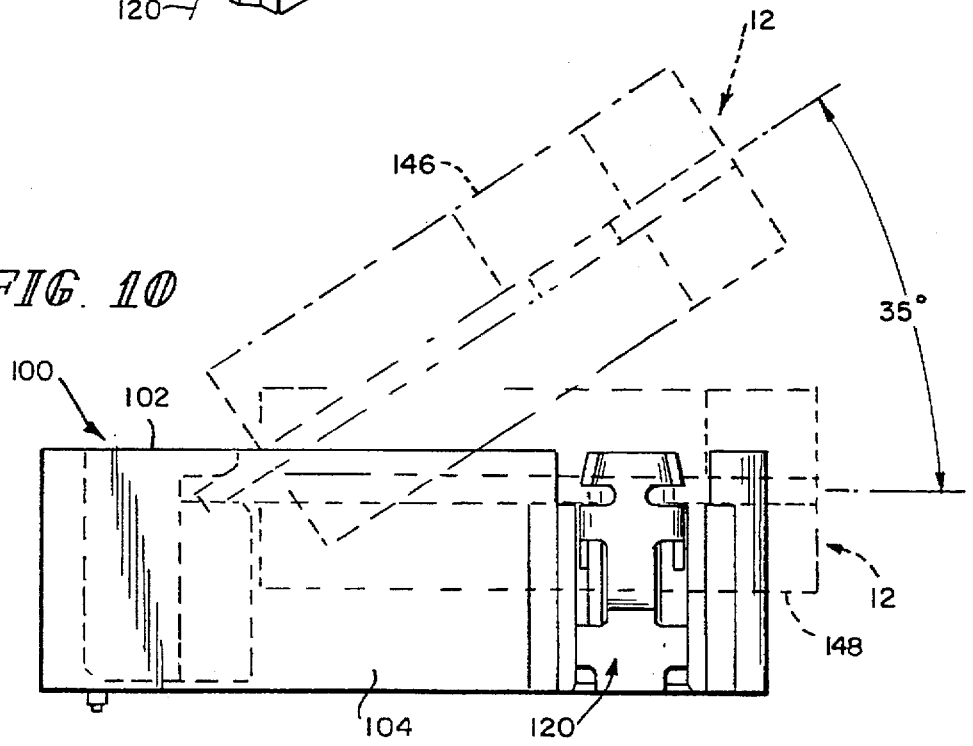
FIG. 10 is a side elevational view illustrating insertion of a memory module into the connector of FIG. 9.

FIG. 5 illustrates metal clip 36 installed into side arm 24. Memory module is installed into connector 10 by first inserting memory module 12 in an angled orientation of about 35° as illustrated in FIG. 10. Memory module 12 is then rotated downwardly toward side arms 24 and 26 in the direction of arrows 79. During such rotation, portions of memory module 12 adjacent side notch 48 engage ramped heads 50 and 52 to force the locking members 42 and 44 of split peg 28 together in the directions of arrows 80 and 82, respectively. It is understood that apertures can be formed in the module 12 spaced inwardly from side edges 32 and 34. In this embodiment, the split pegs engage the module 12 adjacent these apertures instead of side notches 48. After memory module 12 moves beneath heads 50 and 52, locking members 42 and 44 spring back to their unbiased positions so that locking heads 50 and 52 move over a portion of memory module 12 adjacent side notch 48 to lock memory module 12 in place on connector 10. This locked position is best illustrated in FIG. 6. FIG. 7 illustrates how a bottom surface 84 of head 52 overlaps a top surface 86 of memory module 12 to secure memory module 12 to connector 10.

Figure 8:
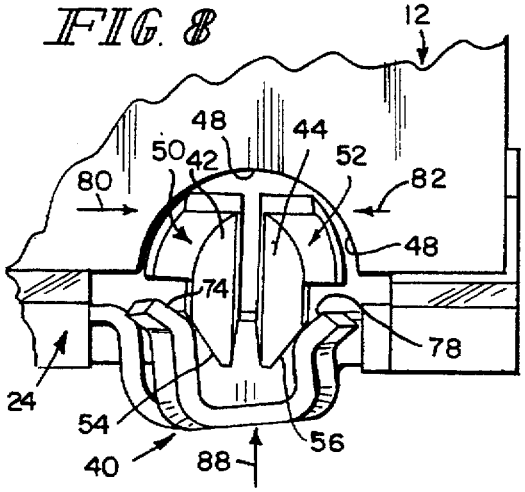
FIG. 8 is a top plan view similar to FIG. 6 illustrating actuation of the split peg by the metal clip to disengage the memory module from the connector.

When it is desired to remove a memory module 12 from connector 10, actuator section 40 of metal clip 36 is forced inwardly toward split pegs 28 and the memory module 12 in the direction of arrow 88 in FIGS. 5 and 8. This inward movement of actuator section 40 causes ramp section 74 of arm 72 to engage ramp 54 of locking member 42. In addition, ramp section 78 of arm 76 engages ramp section 56 of locking member 44. This forces locking members 42 and 44 inwardly toward each other in opposite directions as illustrated by arrows 80 and 82, respectively. Actuator section 40 is moved inwardly in the direction of arrow 88 until the heads 50 and 52 clear the notched section 48 of memory module 12 as illustrated in FIG. 8. This permits the memory module 12 to pivot upwardly out of engagement with split peg 28 due to the torque applied by contacts 20 in connector 10. Actuator section moves locking members 42 and 44 in opposite directions generally parallel to side arm 24.

The configuration of the present invention facilitates insertion and removal of memory module 12 from connector 10. By providing split pegs 28 and 30 on first and second side arms 24 and 26, respectively, the memory module 12 can be released by metal clips 36 and 38 by applying inwardly directed forces with a thumb and finger of an operator. This squeezing inwardly of clips 36 and 38 to release memory module 12 is simpler than pulling out separate metal or plastic latches in a direction outwardly from the connector as is the case in conventional module locking assemblies.

Figure 9:
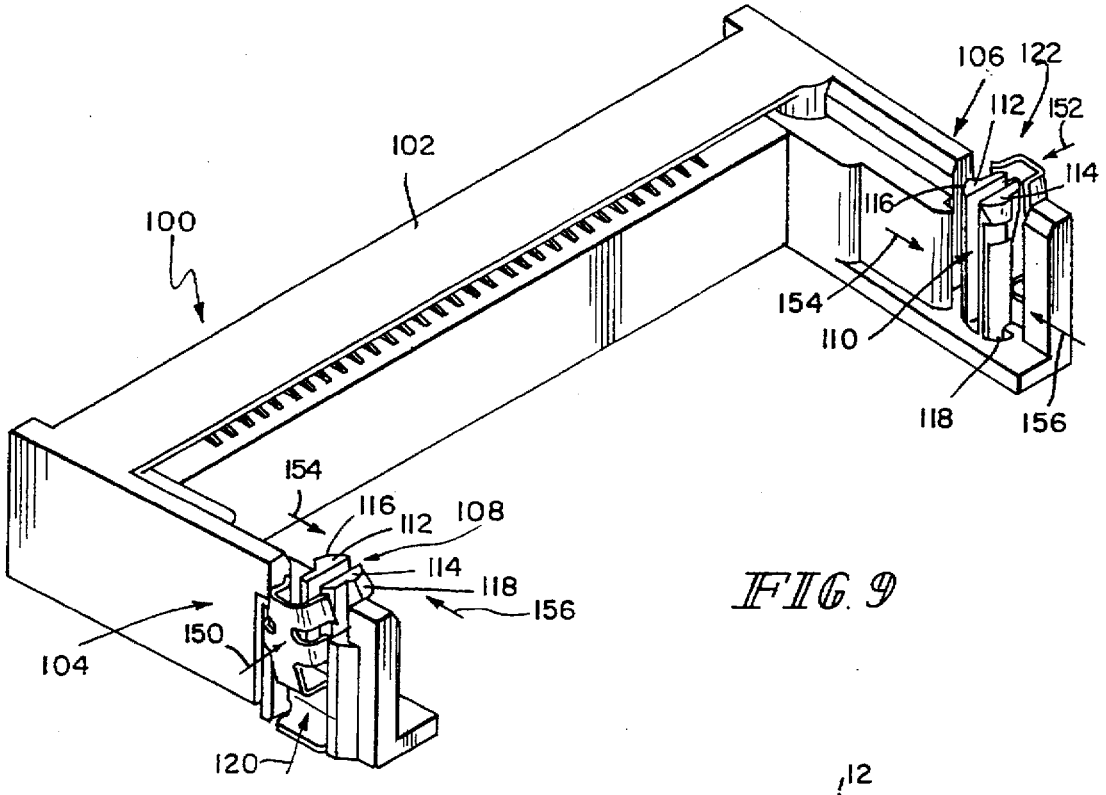
FIG. 9 is a perspective view of a second embodiment of the present invention.
Figure 11:
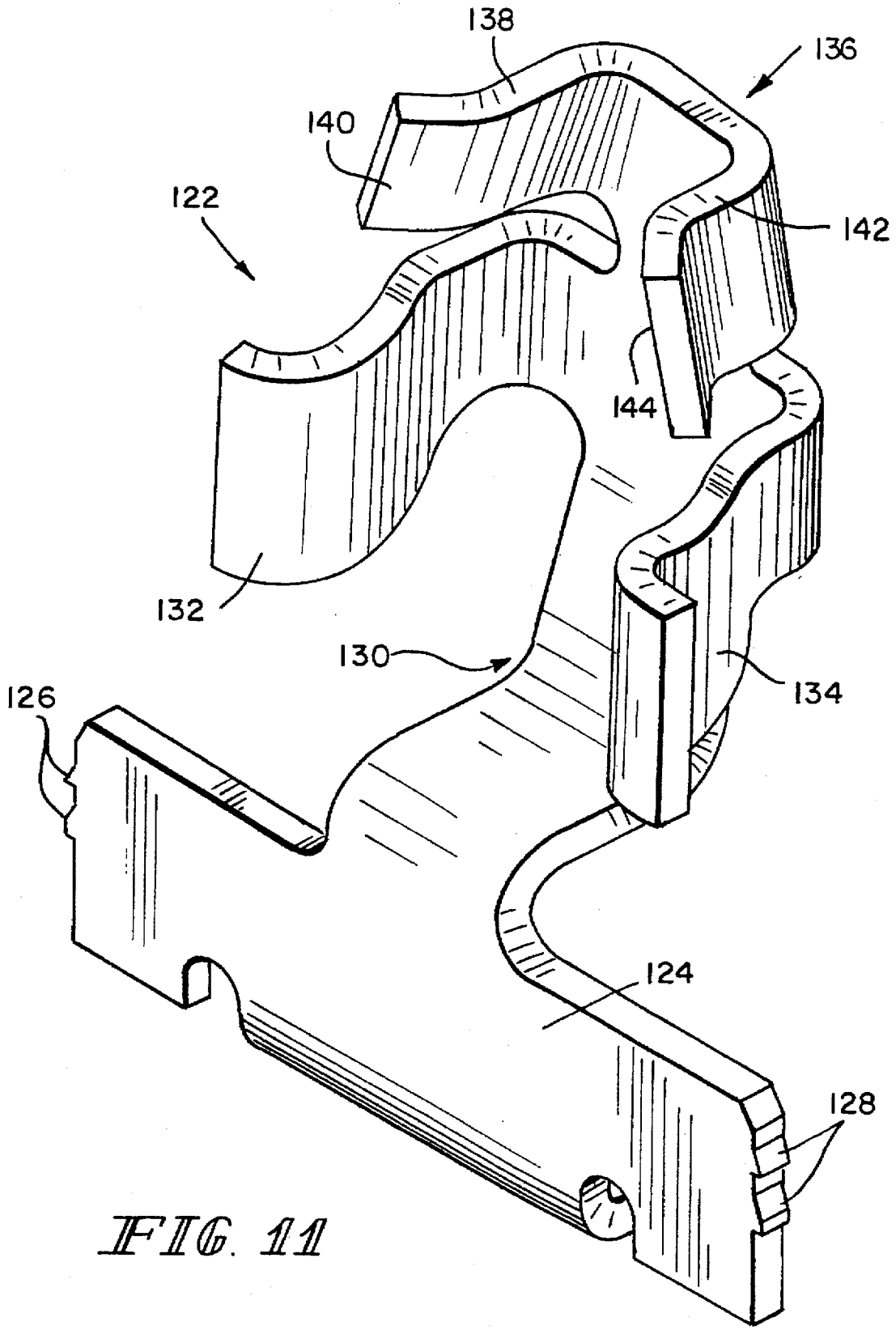
FIG. 11 is a perspective view illustrating details of a second metal clip for use with the electrical connector of FIG. 9 to disengage the split pegs from the memory modules.

Another embodiment of the present invention is illustrated in FIGS. 9–11. This second embodiment of the present invention is a SOJ tall small outline DIMM connector 100. Connector 100 includes an insulative plastic connector housing 102 having opposite side arms 104 and 106. This connector 100 is designed to accommodate memory modules having an increased thickness. Connector 100 includes a pair of split pegs 108 and 110 formed integrally with side arms 104 and 106, respectively. Split peg 108 is a mirror image of split peg 100. Split peg 108 includes spaced apart, cantilevered locking members 112 and 114. Locking members 112 and 114 include locking ramp heads 116 and 118, respectively, which are similar to locking heads 50 and 52 of split pegs 28 discussed above. A pair of separate metal clips 120 and 122 are provided to actuate split pegs 108 and 110, respectively, to release memory module 12 from connector 10 in a same manner as discussed above. Again, metal clips 120 and 122 are mirror symmetrical. Metal clip 122 is illustrated in FIG. 11. Metal clips 120 and 122 are formed from a stamped sheet metal material. Metal clip 122 includes a base portion 124 having barbs 126 and 128 formed on opposite sides of base 124. Barbs 126 and 128 are configured to engage the insulative housing 102 to secure metal clip 122 to second side arm 106. Clip 122 includes a cantilevered body portion 130 having first and second retention arms 132 and 134. Retention arms 132 and 134 are configured to move within slots formed in side arm 106 to permit the U-shaped actuator section 136 to move relative to split peg 110. Actuator section 136 includes a first arm 138 having ramp section 140 and a second arm section 142 having a ramp section 144. Ramps 140 and 144 are formed to engage ramp sections of split peg 110 in a manner similar to the manner discussed above to force the locking members 112 and 114 inwardly and permit module 12 to be removed.

Installation of module 12 into connector 100 is illustrated in FIG. 10. As the module 12 is rotated downwardly from the first dotted position 146 to the second dotted position 148, portions of the module 12 adjacent side notches 48 engage ramped heads 116 and 118 on split pegs 108 and 110 to force locking members 112 and 114 together. After module reaches the dotted position 148, split pegs 108 and 110 snap back to the unbiased position to lock the module 12 in position on connector 100. When it is desired to release module 12, opposing inwardly directed forces are applied in the direction of arrows 150 and 152 to metal clips 120 and 122, respectively. These forces cause clips 120 and 122 to force locking members 112 and 114 to move inwardly toward each other in the directions of arrows 154 and 156, respectively, to release module 12 from connector 100 in a manner similar to the manner discussed above.

Although the invention has been described in detail with reference to a certain preferred embodiment, variations and modifications exist within the scope and spirit of the present invention as described and defined in the following claims.

What is claimed is:

1. A connector apparatus for electrically coupling a module having an end edge including a plurality of conductive pads to a plurality of conductive traces on a printed circuit board, the apparatus comprising:

an insulative housing formed to include an elongated slot for receiving the end edge of the module, a plurality of contacts located in the slot for engaging the conductive pads on the module, the housing including an insulative side arm having at least one insulative cantilevered locking member for engaging the module to secure the module to the housing; and a clip coupled to the side arm of the housing, the clip including an actuator section located adjacent the at least one locking member, the actuator section being configured to engage the at least one locking member and move the locking member in a direction generally parallel to a longitudinal axis of the side arm of the housing to disengage the locking member from the module to permit removal of the module from the housing.

2. The apparatus of claim 1, wherein the housing includes a split peg configured to engage the module to secure the module to the housing.

3. The apparatus of claim 2, wherein the module is formed to include an aperture, and the split peg includes first and second spaced apart cantilevered locking members for engaging the module adjacent the aperture to secure the module to the housing.

4. The apparatus of claim 3, wherein the clip includes a generally U-shaped actuator section having first and second arms for engaging and moving the first and second locking members to disengage the first and second locking members from the module.

5. The apparatus of claim 4, wherein the first and second locking members each include a ramp portion for engaging the first and second arms of the actuator section of the clip, respectively, to move the first and second locking members relative to the module.

6. The apparatus of claim 1, wherein the at least one locking member includes a locking head having a ramp surface configured to engage the module to move the locking member relative to the housing during installation of the module.

7. The apparatus of claim 6, wherein the locking head includes a bottom surface configured to engage the module to secure the module to the housing.

8. The apparatus of claim 1, wherein the clip is formed from a metal material.

9. The apparatus of claim 8, wherein the clip includes a retention section configured to engage the side arm of the housing to secure the clip to the housing.

10. A connector apparatus for electrically coupling a module having an end edge including a plurality of conductive pads to a plurality of conductive traces on a printed circuit board, the apparatus comprising:

an insulative housing formed to include an elongated slot for receiving the end edge of the module, and first and second arms extending away from opposite ends of the slot;

first and second locking members coupled to the first and second side arms, respectively, for engaging opposite side edges of the module to secure the module to the electrical connector; and first and second actuators coupled to the first and second side arms, respectively, adjacent the first and second locking members, the first and second actuators being separate members from the side arms and the locking members and being configured to engage and move the locking members and release the module from the housing when opposite, inward forces directed toward the module are applied to the first and second actuators.

11. The apparatus of claim 10, wherein the first and second locking members each include a pair of cantilevered beams for engaging the module to secure the module to the housing.

12. The apparatus of claim 11, wherein the first and second actuators each include a pair of arms configured to engage the pair of cantilevered beams to disengage the cantilevered beams from the module.

13. The apparatus of claim 12, wherein the cantilevered beams each include an unlocking ramp portion for engaging the first and second arms of the actuators to move the cantilevered beams relative to the module.

14. The apparatus of claim 10, wherein the locking members each include a locking head having a ramp surface configured to engage the module to move the locking member relative to the housing during installation of the module.

15. The apparatus of claim 14, wherein the locking heads each include a bottom surface configured to engage the module to secure the module to the housing.

16. The apparatus of claim 10, wherein the first and second actuators are formed from a metal material.

17. The apparatus of claim 10, wherein the module is formed to include first and second apertures, and the first and second locking members are cantilevered locking members configured to engage the module adjacent the first and second apertures, respectively, to secure the module to the housing.

18. The apparatus of claim 17, wherein the first and second actuators are configured to move the first and second locking members, respectively, in a direction generally parallel to the first and second side arms of the housing to disengage first and second locking members from the module.

19. A connector apparatus for electrically coupling a module having an end edge including a plurality of conductive pads to a plurality of conductive traces on a printed circuit board, the apparatus comprising:

an insulative housing formed to include an elongated slot for receiving the end edge of the module, a plurality of contacts located in the slot for engaging the conductive pads on the module, and first and second side arms, each of the first and second side arms having an integrally formed split peg for engaging first and second opposite side edges of the module to secure the module to the housing; and first and second clips coupled to the first and second arms of the housing, respectively, the first and second clips each including an actuator section located adjacent the first and second split pegs, respectively, the actuator sections being configured to engage and move the first and second split pegs in a direction generally parallel to the first and second side arms of the housing to disengage split pegs from the module to disengage the split pegs from the first and second side edges of the module to permit removal of the module from the connector housing.

20. The apparatus of claim 19, wherein the first and second split pegs each include first and second spaced apart cantilevered locking members for engaging the module to secure the module to the housing.

21. The apparatus of claim 20, wherein the first and second locking members each include a locking head having a ramp surface configured to engage the module to move the locking member relative to the housing during installation of the module.

22. The apparatus of claim 21, wherein the locking heads each include a bottom surface configured to engage the module to secure the module to the housing.

23. The apparatus of claim 20, wherein the first and second clips include a generally U-shaped actuator section having first and second arms for engaging the first and second locking members to release the module from the housing.

24. The apparatus of claim 23, wherein the locking members include first and second unlocking ramp portions for engaging the first and second arms of the actuator section, respectively, to move and release the locking members from the module.

25. The apparatus of claim 19, wherein the clips are formed from a metal material.

26. The apparatus of claim 19, wherein the module is formed to include first and second apertures, the split pegs being configured to engage the module adjacent the first and second apertures to secure the module to the housing.

* * * * *